US005546664A

United States Patent [19]

Kuo

[11] Patent Number: 5,546,664

[45] Date of Patent: Aug. 20, 1996

[54] COMPASS ABLE TO DRAW ANY-SIZE ELLIPSES

[76] Inventor: Ming-Shish Kuo, No. 26-1, Alley 43, Lane 344 Chung-Chen S. Road, Yung-Kang City, Tainan Shien, Taiwan 710, Taiwan

[21] Appl. No.: 526,582

[22] Filed: Sep. 11, 1995

[51] Int. Cl.[6] ..... B43L 11/055

[52] U.S. Cl. ..... 33/30.3; 33/30.1

[58] Field of Search ..... 33/27.01, 30.1, 33/30.2, 30.3, 30.4, 30.5, 30.6, 30.7, 31

[56] References Cited

U.S. PATENT DOCUMENTS

| | | | |
|---|---|---|---|
| 324,395 | 8/1885 | Marichaz | 33/30.2 |
| 988,188 | 3/1911 | Graham | 33/30.6 |
| 1,168,546 | 1/1916 | Odin | 33/30.1 |
| 1,872,973 | 8/1932 | Kittel | 33/30.1 |
| 2,493,229 | 1/1950 | Dibrell et al. | 33/30.2 |
| 2,690,013 | 9/1954 | MacGuire | 33/30.2 |
| 3,016,611 | 1/1962 | Arthur | 33/30.3 |
| 3,104,466 | 9/1963 | King | 33/30.3 |
| 4,010,546 | 3/1977 | Ching-Tien | 33/30.1 |
| 4,150,487 | 4/1979 | Grundman | 33/30.1 |
| 4,170,824 | 10/1979 | Mikulin | 33/30.2 |

FOREIGN PATENT DOCUMENTS

| | | | |
|---|---|---|---|
| 3001995 | 1/1991 | Japan | 33/30.1 |

*Primary Examiner*—Thomas B. Will

[57] ABSTRACT

A compass able to draw any-size ellipses consists of a body, a first and a second position ring, a movable rod, a pen rod, a position rod and a coil spring. The first and the second position ring are screwed on an upper and a lower portion of the body respectively. The movable rod is fitted in a lengthwise center hole of the body. The pen rod is combined on a lengthwise opening of the movable rod. The position rod is fitted in a tubular chamber of the movable rod, with the coil spring fitted around the position rod. The movable rod can move up and down to rotate the pen rod, and the pen rod can be turned around the body for one round by pushing down and up of the movable rod to draw any-size ellipses.

1 Claim, 5 Drawing Sheets

COMPASS ABLE TO DRAW ANY-SIZE ELLIPSES

BACKGROUND OF THE INVENTION

This invention concerns a compass able to draw ellipses of any size, particularly capable to draw ellipses of various size by a pen rod moving one round around a compass main body.

So far known, methods used for drawing ellipses are those for drawing a concentric circle, an approximate four-centered ellipse, and an approximate eight-centered ellipse. However, they are all complicated, and in addition, a completed ellipse has to be trimmed off unnecessary lines, with the ellipse got being not exactly accurate.

SUMMARY OF THE INVENTION

This invention has been devised to offer a kind of compass capable to draw out ellipses of any size.

A compass able to draw any-size ellipses consists of a body, a first and a second position ring, a movable rod, a pen rod, a position rod and a coil spring.

The body has a lengthwise flat slide surface, a graduation on the flat slide surface, a lengthwise male thread on the outer surface except the flat slide surface, and a lengthwise center through hole, and a lengthwise opening in the flat slide surface communicating with the center through hole.

The first and a second position ring are movably screwed with an upper and a lower portion of the male thread of the body respectively so that the distance between them is adjustable.

The movable rod is contained movable up and down in the center through hole of the body, having an upper grip end, a tubular chamber and a curved opening communicating with the tubular chamber.

The pen rod is combined movable up and down on the opening of the movable rod, having a rod holding band pivotally combined with the top to fit around the movable rod. The rod holding band has a projection on an inner surface. The pen rod further has a pen combined at a lower end and able to be bent at any angle relative to the pen rod body.

The position rod is contained in the tubular chamber of the movable rod, having a cone-shaped lower end with a needle extending down, and a disc stop on the cone-shaped end.

The coil spring is fitted around the position rod on the cone-shaped end, with its upper end urgingly reeiving a bottom end of the movable rod.

The needle of the position rod is to be placed on the center of an ellipse to be drawn, and the first and the second position ring are adjusted in the distance between them in accordance with the size of the ellipse to be drawn. Then the movable rod is pushed down or up, pressing and rotating the pen rod, with the pen moving from one end point of a short axis to one end point of a long axis for one fourth round to draw out one fourth of the ellipse wanted and then moving from that end point of the long axis to the other end point of the short axis to draw out another fourth round of the ellipse wanted. Then the movable rod and the pen rod are further moved to repeat the above mentioned movement for the pen to draw the other half of the ellipse wanted.

BRIEF DESCRIPTION OF DRAWINGS

This invention will be better understood by reference to the accompanying drawings, wherein.

DESCRIPTION OF THE PREFERRED EMBODIMENT

Figure 1:
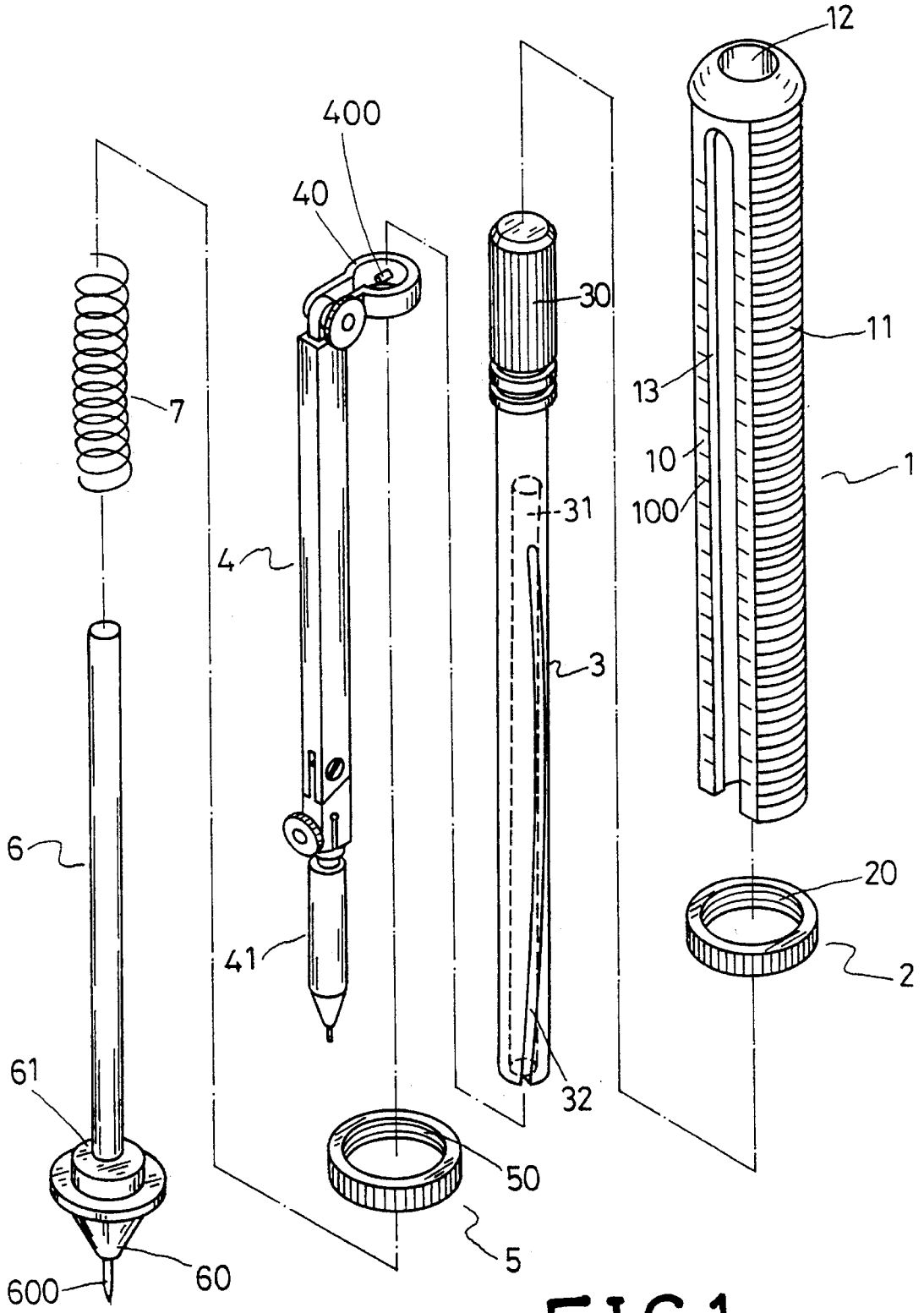
FIG. 1 is an exploded perspective view of a compass able to draw any-size ellipses in the present invention.

A preferred embodiment of a compass able to draw FIG. 1, includes a body 1, a first position ring 2, a movable rod 3, a pen rod 4, a second position ring 5, a position rod 6, and a coil spring 7 as components combined together.

The body 1 has a lengthwise flat slide surface 10, a graduation on the flat slide surface 100, a lengthwise male thread 11 on an outer surface except the slide surface 10, a center through hole 12, and a lengthwise opening 13 in the slide surface 10 communicating with the center through hole 12.

The first position ring 2 has a female thread 20, engaging movably with an upper portion of the male thread 11 of body 1.

The movable rod 3 is to be movably positioned in the center through hole 12 of the body 1, having a grip 30 formed at an upper end, a lengthwise tubular chamber 31 opening to a bottom and closed at an upper end, and a lengthwise slowly curved groove 32 communicating with the tubular chamber 31.

The pen rod 4 is movably located on the slide groove 32 of the movable rod 3, having a rod holding band 40 pivotally connected with a top end, a projection 400 on an inner surface of the band 40, and a pen 41 connected at a lower end and adjustable in its angle relative to the pen rod body.

The second position ring 5 is to engage movably with a lower portion of the male thread of the body 1, having a female thread 50 in an inner surface to engage the male thread 11 of the body 1.

The position rod 6 is contained in the tubular chamber 31 of the movable rod 3, having a cone-shaped lower end 60 with a needle 600 extending down, and a disc-shaped stop 61 on the cone-shaped lower end 60.

The coil spring 7 is fitted around the position rod 6, with its lower end resting on the cone-shaped lower end 60, and with its upper end supporting a bottom end of the movable rod 3 with its resilience so as to permit the movable rod moving up and down in the center through hole of the body 1.

Figure 2:
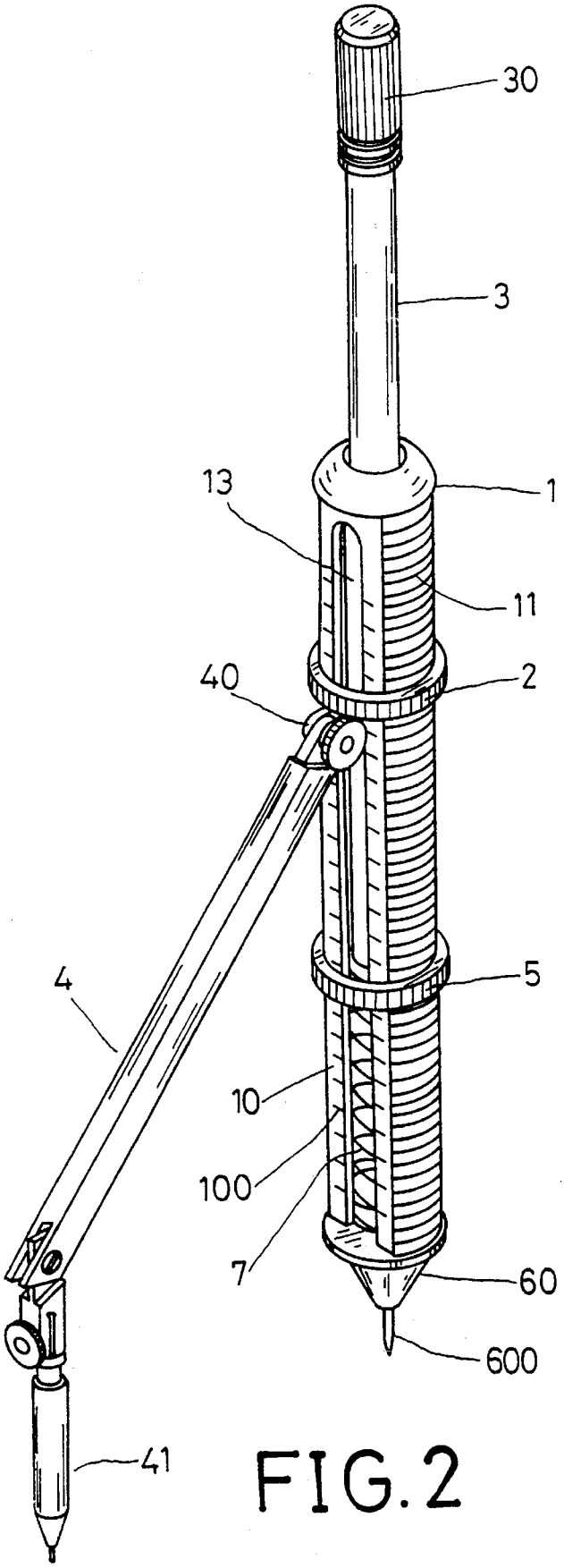
FIG. 2 is a perspective view of the compass able to draw any-size ellipses in the present invention.
Figure 3:
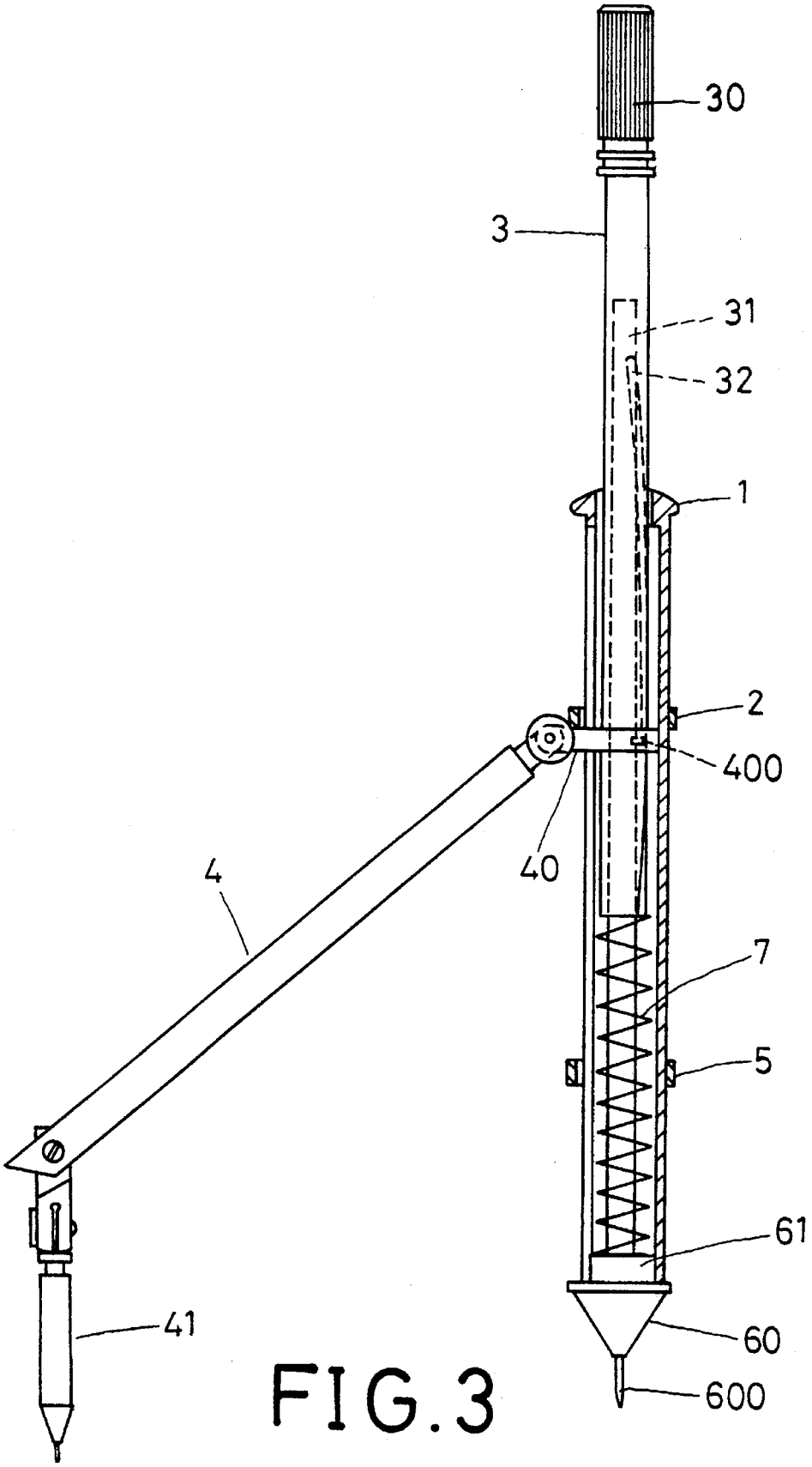
FIG. 3 is a cross-sectional view of the compass able to draw any-size ellipses in the present invention.

In assembling, referring to FIGS. 1, 2 and 3, firstly, the first position ring 2 is screwed with a proper upper portion of the male thread 11 of the body 1, and next, the pen rod 4 is combined with the movable rod, with the projection 400 fitted in the curved groove 32, with the rod holding band 40 together with the pen rod 4 and with the movable rod 3 inserted from under in the center through hole 12 of the body 1, and with the grip 30 always protruding out of an upper end of the center through hole 12. Then the pen rod 4 is located outside of the opening 13 of the body 1. Next, the second position ring 5 is screwed with a proper lower portion of the male thread 11 of the body 1. Lastly, the coil spring 7 is fitted around the body of the position rod 6, with its lower end resting on the disc-shaped stop 61, and the position rod 6 is inserted from under in the tubular chamber 31 of the movable rod 3, with the disc stop 61 located at the lower end of the center through hole 12 of the body 1.

Figure 4:
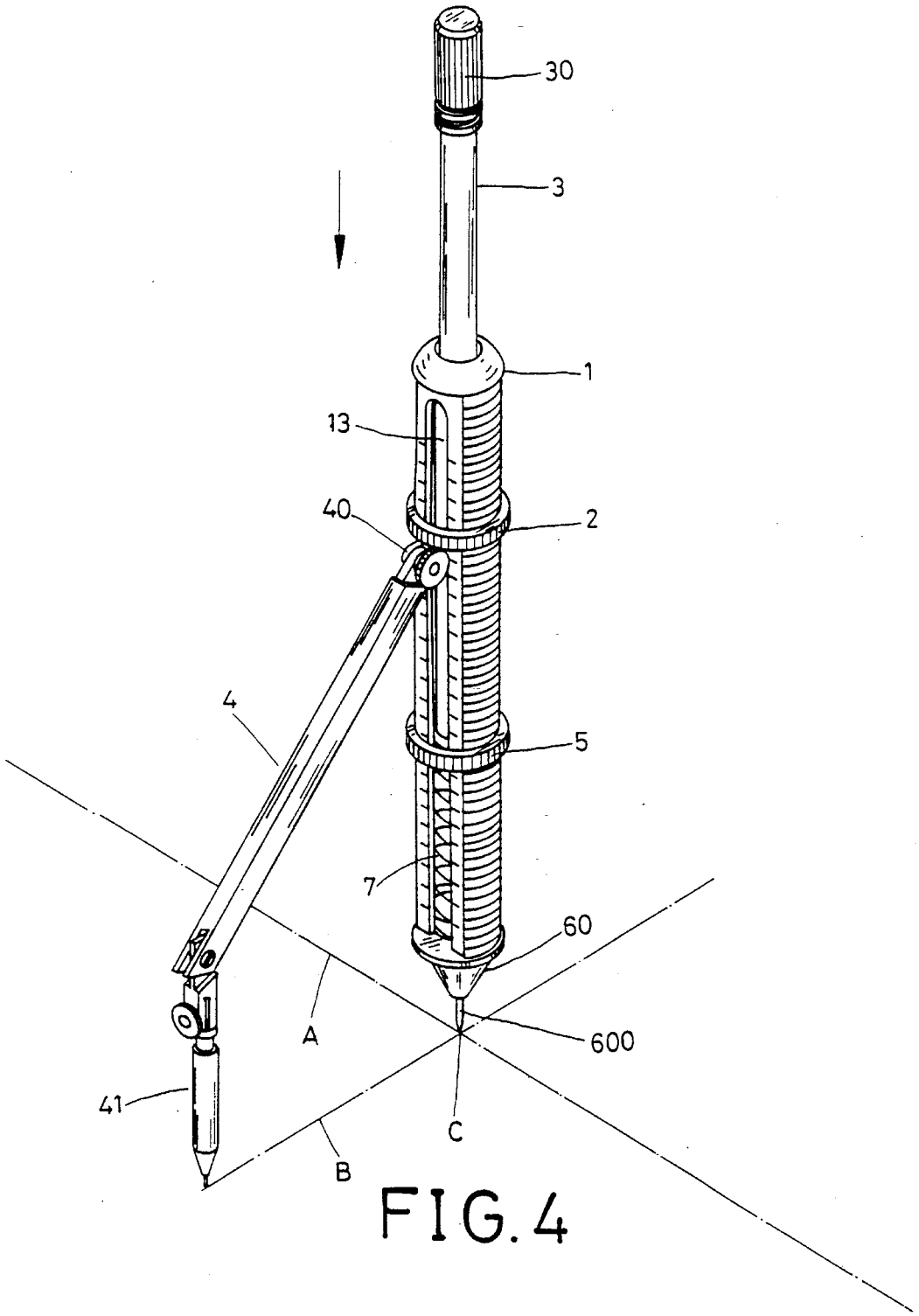
FIG. 4 is a perspective view of the compass able to draw any-size ellipses in the present invention, showing it being used practically for drawing.
Figure 5:
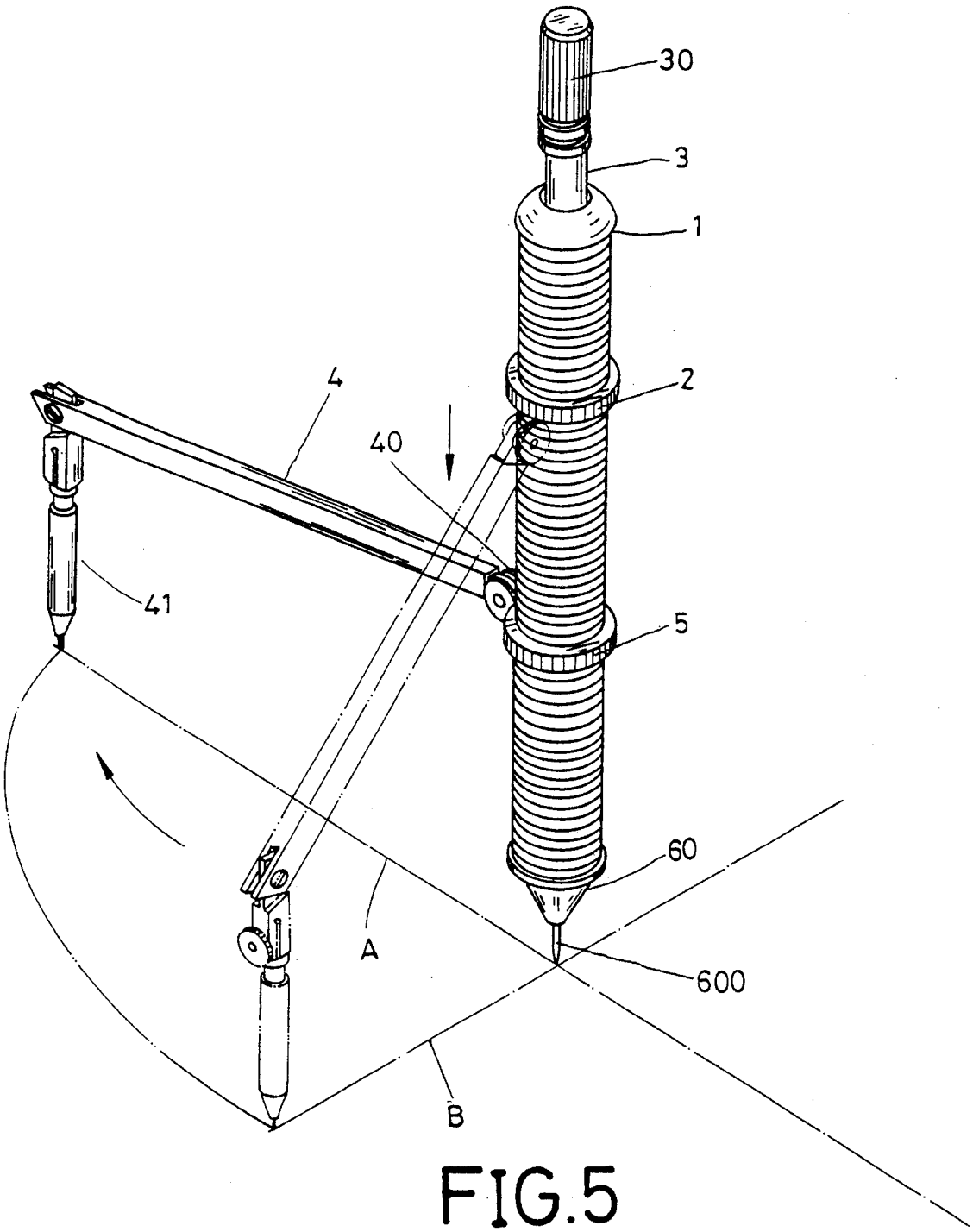
FIG. 5 is another perspective view of the compass able to draw any-size ellipses in the present invention, showing it being used practically for drawing.

In using, referring to FIG. 4, at first, in advance, a long axis A and a short axis B are drawn on a paper, and then the needle 600 of the position rod 6 is placed on the crossing point C of the two axes A and B, with the crossing point C functioning as the center of an ellipse to be drawn. Next, the pen 41 of the pen rod 4 is placed on one end point of the short axis B, and the first and the second position rings 2 and 5 are adjusted in the distance between them according to the length of the long and the short axis A and B. The longer the distance between the first and the second ring 2 and 5 is, the larger the ellipse to be drawn will be. On the contrary, the shorter the distance between the first and the second ring is, the smaller the ellipse to be drawn will be, and more similar to a round circle. In drawing, a user holds the grip 30 of the movable rod 3, with the body 1 precisely located on the crossing point C. In drawing one fourth of the ellipse wanted, the movable rod 3 is pressed down at the grip 30, permitting the rod holding band 40 sliding along the slide groove 32 with the projection 400 guided thereby, with the pen rod 4 gradually moving down and outward,: referring to FIG. 2. In this way, the pen 41 is moved from one end point of the short axis to one end point of the long axis, drawing out one fourth of the ellipse wanted, as shown in FIG. 5. Then the movable rod 3 is to be gradually released to move up and to turn the pen rod 4, with the pen 41 moving from the end point of the long axis A to the other end point of the short axis B, drawing out the second fourth round of the ellipse wanted. After that, the above mentioned movement of the movable rod and the pen rod is repeated to finish the other half round of the ellipse wanted.

As can be understood from the above description, this invention has the following merits.

1. An ellipse wanted can be drawn with one round of movement of the pen rod around the body.

2. Any ellipse of different size and proportion can be drawn with it.

3. It is easy to use, and simple to operate.

While the preferred embodiment of the invention has been described above, it will be recognized and understood that various modifications may be made therein and the appended claims are intended to cover all such modifications which may fall within the spirit and scope of the invention.

What is claimed is:

1. A compass able to draw any-size ellipses, comprising:

a body having a lengthwise flat slide surface, a graduation on said flat slide surface, a lengthwise male thread on an outer surface except said flat slide surface, a lengthwise center through hole, and a lengthwise opening in said flat slide surface communicating with said center through hole;

a first and a second position ring having a female thread to screw with an upper proper and a lower proper portion of said male thread of said body respectively;

a movable rod contained in said center through hole, having a grip formed at an upper end, a lengthwise tubular chamber opening to a bottom end and closed at an upper end, a lengthwise slowly curved groove communicating with said tubular chamber;

a pen rod movably fitted on said opening of said movable rod, having a rod holding band pivotally connected with an upper end, a projection on an inner surface of said rod holding band, and a pen connected at a lower end and adjustable in its angle relative to said pen rod;

a position rod contained in said tubular chamber of said movable rod, having a cone-shaped lower end with a needle extending straight down, and a disc stop on said cone-shaped end;

a coil spring fitted around said position rod, with its lower end resting on said cone-shaped lower end of said position rod and with its upper end supporting a bottom end of said movable rod within said center through hole of said body; and said first and said second position ring being adjusted in the distance between them according to the length of a long axis and a short axis in drawing an ellipse, said needle of said position rod being made to stand on a crossing point of said long and said short axis, said grip of said movable rod being pressed down to force said projection of said rod holding band of said pen rod move along said slide groove of said movable rod, said pen rod gradually being pushed down to extend outward and turned at the same time for one fourth round and with the top of said pen rod moving down for the distance between said two position rings, said pen moving according to movement of the pen rod and starting from one end point of said short axis to move to one end point of said long axis and drawing one fourth of an ellipse wanted, then said pen rod being pushed up and turned further for one fourth round once again and with the top thereof moving up for the distance between said two position rings, then said pen drawing another fourth of the ellipse wanted by moving from the end point of said long axis to the other end point of said short axis, then another half of the ellipse wanted being able to be drawn by repeating another half round of movement of said pen rod with said pen as described above, said pen rod being rotated for one round with its top end moving up and down for twice between said distance between said two position rings for finishing drawing an ellipse wanted.

* * * * *